US009562705B2

(12) United States Patent
Cupps et al.

(10) Patent No.: US 9,562,705 B2
(45) Date of Patent: Feb. 7, 2017

(54) ENERGY RECOVERY APPARATUS FOR USE IN A REFRIGERATION SYSTEM

(71) Applicant: Regal Beloit America, Inc., Beloit, WI (US)

(72) Inventors: Jay M. Cupps, Cassville, MO (US); Steven W. Post, Cassville, MO (US)

(73) Assignee: Regal Beloit America, Inc., Beloit, WI (US)

( * ) Notice: Subject to any disclaimer, the term of this patent is extended or adjusted under 35 U.S.C. 154(b) by 123 days.

(21) Appl. No.: 14/179,899

(22) Filed: Feb. 13, 2014

(65) Prior Publication Data

US 2015/0226466 A1 Aug. 13, 2015

(51) Int. Cl.

| | |
|---|---|
| ***F25D 9/00*** | (2006.01) |
| ***F25B 11/02*** | (2006.01) |
| ***F25B 11/00*** | (2006.01) |
| ***F25B 41/00*** | (2006.01) |

(52) U.S. Cl.

CPC ..... *F25B 11/02* (2013.01); *F25B 11/00* (2013.01); *F25B 41/00* (2013.01); *F25B 2309/005* (2013.01); *F25B 2400/14* (2013.01); *F25B 2400/141* (2013.01); *F25B 2600/0252* (2013.01)

(58) Field of Classification Search

CPC . F25B 2400/14; F25B 2400/141; F25B 41/00; F25B 2600/0252; F25B 11/00; F25B 11/02; F25B 2309/005

USPC ..... 62/87, 401

See application file for complete search history.

(56) References Cited

U.S. PATENT DOCUMENTS

| | | | | |
|---|---|---|---|---|
| 2,494,120 A | | 1/1950 | Ferro, Jr. | |
| 3,408,046 A | | 10/1968 | Wollenweber, Jr. et al. | |
| 3,934,424 A | | 1/1976 | Goldsberry | |
| 3,972,195 A | * | 8/1976 | Hays | F01D 1/06 416/197 R |
| 4,170,116 A | * | 10/1979 | Williams | F01K 21/005 60/671 |

(Continued)

FOREIGN PATENT DOCUMENTS

| | | |
|---|---|---|
| WO | 2006/066347 A1 | 6/2006 |
| WO | 2012/050840 A1 | 4/2012 |

OTHER PUBLICATIONS

International Search Report and Written Opinion for PCT/US2011/053500 dated Feb. 22, 2012.

*Primary Examiner* — Jianying Atkisson
*Assistant Examiner* — David Teitelbaum
(74) *Attorney, Agent, or Firm* — Thompson Coburn LLP; Alan Norman

(57) ABSTRACT

An energy recovery apparatus, for use in a refrigeration system, comprises a first nozzle, a second nozzle, a turbine, a discharge port, and a housing. The first nozzle comprises a first passageway which is adapted to constitute a portion of a refrigerant flow path when the refrigeration system is operated in a first mode. The second nozzle comprises a second conduit which is adapted to constitute a portion of the flow path when the refrigeration system is operated in a second mode. The turbine is positioned to be driven by refrigerant discharged from either or both of the first and second passageways. The discharge port is adapted to permit refrigerant to flow out of the energy recovery apparatus. The discharge port of the energy recovery apparatus is downstream of the turbine. The turbine is within the housing.

20 Claims, 9 Drawing Sheets

(56) References Cited

U.S. PATENT DOCUMENTS

| | | | | |
|---|---|---|---|---|
| 4,336,693 | A * | 6/1982 | Hays | F01D 1/32 60/651 |
| 5,103,651 | A | 4/1992 | Coelho et al. | |
| 5,186,013 | A | 2/1993 | Durso | |
| 5,467,613 | A | 11/1995 | Brasz | |
| 5,819,554 | A | 10/1998 | Glen | |
| 6,134,901 | A * | 10/2000 | Harvest | F24F 11/008 62/157 |
| 6,173,763 | B1 * | 1/2001 | Sano | F28F 1/32 165/133 |
| 6,272,871 | B1 | 8/2001 | Eisenhour | |
| 6,543,238 | B2 | 4/2003 | Yamanaka et al. | |
| 7,607,314 | B2 * | 10/2009 | Eisenhour | F25B 11/02 62/197 |
| 7,845,190 | B2 | 12/2010 | Pearson | |
| 8,769,983 | B2 | 7/2014 | Okazaki | |
| 8,776,539 | B2 | 7/2014 | Verma et al. | |
| 8,881,752 | B1 | 11/2014 | Fonteyn | |
| 2008/0122226 | A1 * | 5/2008 | Madison | F01D 13/00 290/52 |
| 2008/0141705 | A1 | 6/2008 | Eisenhour | |
| 2008/0289335 | A1 | 11/2008 | Drysdale | |
| 2009/0301735 | A1 | 12/2009 | Trapp | |
| 2013/0181453 | A1 | 7/2013 | Post et al. | |
| 2014/0196497 | A1 | 7/2014 | Post et al. | |

* cited by examiner

ENERGY RECOVERY APPARATUS FOR USE IN A REFRIGERATION SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

This invention pertains to an energy recovery apparatus for use in a refrigeration system.

SUMMARY OF THE INVENTION

One aspect of the present invention is an energy recovery apparatus for use in a refrigeration system. The refrigeration system comprises an evaporator, a compressor, and a condenser. The refrigeration system is configured to circulate refrigerant along a flow path such that the refrigerant flows from the evaporator to the compressor, and from the compressor to the condenser, and from the condenser to the evaporator. The energy recovery apparatus is adapted and configured to be in the flow path operatively between the condenser and the evaporator. The energy recovery apparatus comprises a first nozzle, a second nozzle, a turbine, a discharge port, and a housing. The first nozzle comprises a first conduit region defining a first passageway. The first passageway is adapted to constitute a portion of the flow path when the refrigeration system is operated in a first mode. The first passageway has a discharge end. The first nozzle is adapted and configured such that refrigerant is expanded as it passes through the first nozzle and is discharged from the discharge end of the first passageway in a liquid-vapor state with a liquid component and a vapor component. The second nozzle comprises a second conduit region defining a second passageway. The second passageway is adapted to constitute a portion of the flow path when the refrigeration system is operated in a second mode. The second passageway has a discharge end. The second nozzle is adapted and configured such that refrigerant is expanded as it passes through the second nozzle and is discharged from the discharge end of the second passageway in a liquid-vapor state with a liquid component and a vapor component. The turbine is positioned and configured to be driven by refrigerant discharged from the discharge end of the first passageway and by refrigerant discharged from the discharge end of the second passageway. The discharge port is adapted to permit refrigerant to flow out of the energy recovery apparatus. The discharge port of the energy recovery apparatus is downstream of the turbine. The turbine is within the housing.

Another aspect of the present invention is a refrigeration system comprising an evaporator, a multi-speed compressor operable in at least a first speed and a second speed different from the first speed, a condenser, and the energy recovery apparatus. The refrigeration system is configured to circulate refrigerant along a flow path such that the refrigerant flows from the evaporator to the compressor, and from the compressor to the condenser, and from the condenser to the energy recovery apparatus, and from the energy recovery apparatus to the evaporator. The refrigeration system is configured and adapted such that the first passageway is in the flow path when the compressor is operated at the first speed. The refrigeration system is configured and adapted such that the second passageway is in the flow path when the compressor is operated at the second speed but not when the compressor is operated at the first speed.

Another aspect of the present invention is a heat pump system adapted to be operated in a heating mode and in a cooling mode. The heat pump system comprises a first heat exchanger, a second heat exchanger, a compressor, and an energy recovery apparatus. The heat pump system is configured to circulate refrigerant along a first flow path when the heat pump system is operated in one of the heating or cooling modes and configured to circulate refrigerant along a second flow path when the heat pump system is operated in the other of the heating or cooling modes. The heat pump system is configured such that refrigerant flowing along the first flow path flows from the first heat exchanger to the compressor, and from the compressor to the second heat exchanger, and from the second heat exchanger to the energy recovery apparatus, and from the energy recovery apparatus to the first heat exchanger. The heat pump system is configured such that refrigerant flowing along the second flow path flows from the second heat exchanger to the compressor, and from the compressor to the first heat exchanger, and from the first heat exchanger to the energy recovery apparatus, and from the energy recovery apparatus to the second heat exchanger. The heat pump system is configured and adapted such that refrigerant flows through the first passageway of the energy recovery apparatus when the heat pump system is operated in the mode which causes refrigerant to flow along the first flow path. The heat pump system is configured and adapted such that refrigerant flows through the second passageway of the energy recovery apparatus when the heat pump system is operated in the mode which causes refrigerant to flow along the second flow path but not when the heat pump system is operated in the mode which causes refrigerant to flow along the first flow path.

Another aspect of the present invention is an energy recovery apparatus for use in a refrigeration system. The refrigeration system comprises an evaporator, a compressor and a condenser. The refrigeration system is configured to circulate refrigerant along a flow path such that the refrigerant flows from the evaporator to the compressor, and from the compressor to the condenser, and from the condenser to the evaporator. The energy recovery apparatus is adapted and configured to be in the flow path operatively between the condenser and the evaporator. The energy recovery apparatus comprises a nozzle apparatus, a turbine, a discharge port, and a housing. The nozzle apparatus is adapted to be in the flow path and configured to expand refrigerant passing through the nozzle apparatus. The nozzle apparatus is adapted to be operable in first and second modes. The nozzle apparatus has a first discharge cross-sectional area through which refrigerant is discharged in a liquid-vapor state with a liquid component and a vapor component when the nozzle apparatus is operated in the first mode. The nozzle apparatus has a second discharge cross-sectional area through which refrigerant is discharged in a liquid-vapor state with a liquid component and a vapor component when the nozzle apparatus is operated in the second mode. The second discharge cross-sectional area is different from the first discharge cross-sectional area. The turbine is positioned and configured to be driven by refrigerant discharged from the first discharge cross-sectional area when the nozzle apparatus is operated in the first mode. The turbine is positioned and configured to be driven by refrigerant discharged from the second discharge cross-sectional area when the nozzle apparatus is operated in the second mode. The discharge port is adapted to permit refrigerant to flow out of the energy recovery apparatus. The discharge port of the energy recovery apparatus is downstream of the turbine. The turbine is within the housing.

Figure 1:
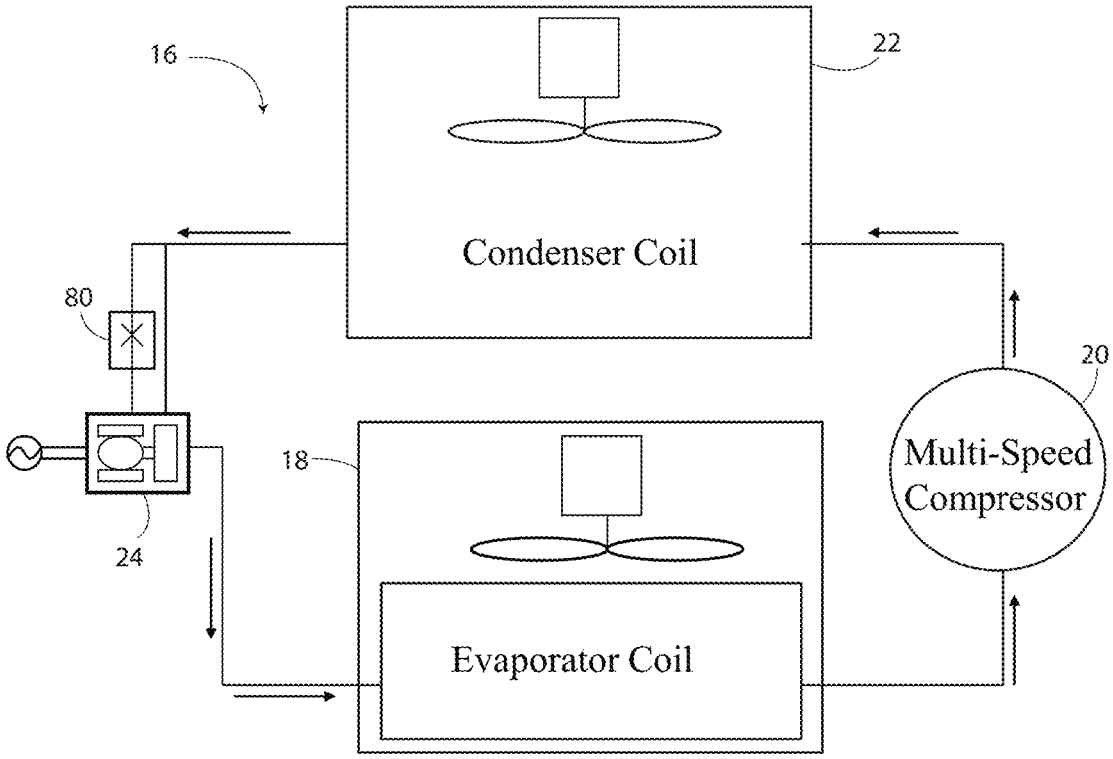
FIG. 1 is a schematic view of an embodiment of a refrigeration system of the present invention, the refrigeration system including a multi-speed compressor and an embodiment of an energy recovery apparatus of the present invention.
Figure 2:
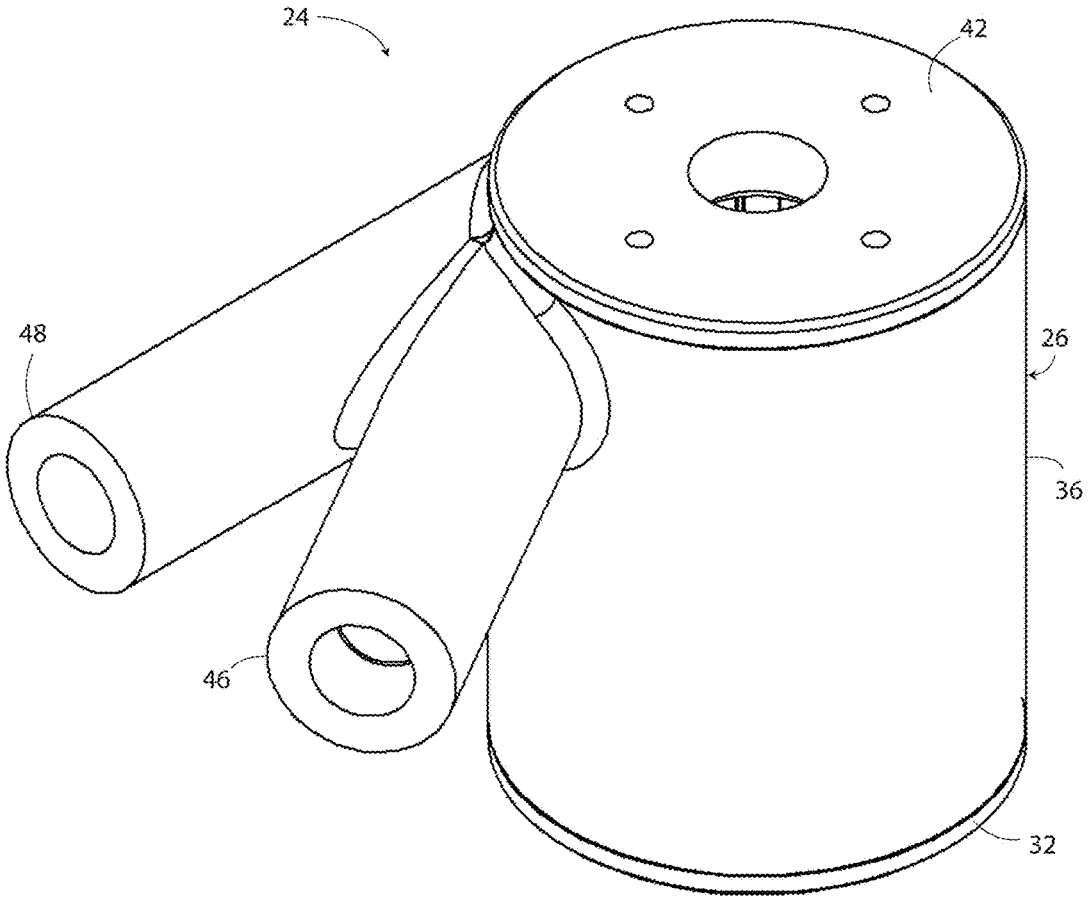
FIG. 2 is a perspective view of the energy recovery apparatus of FIG. 1.
Figure 3:
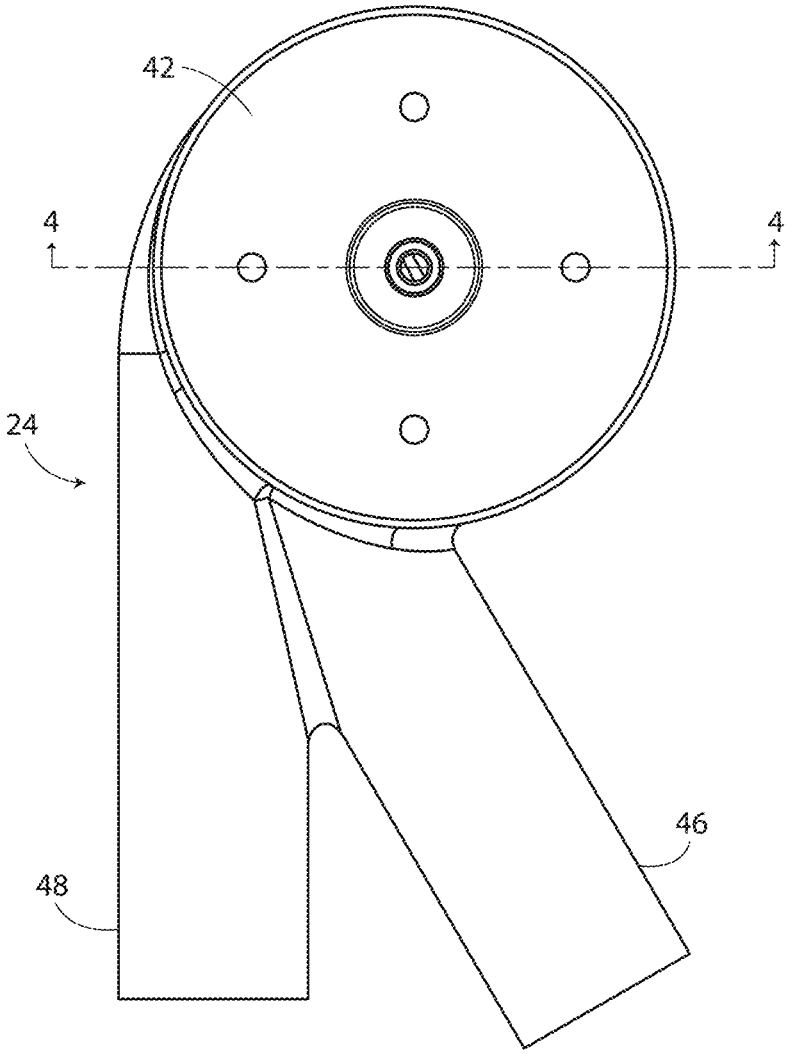
FIG. 3 is a top plan view of the energy recovery apparatus of FIG. 2.
Figure 4:
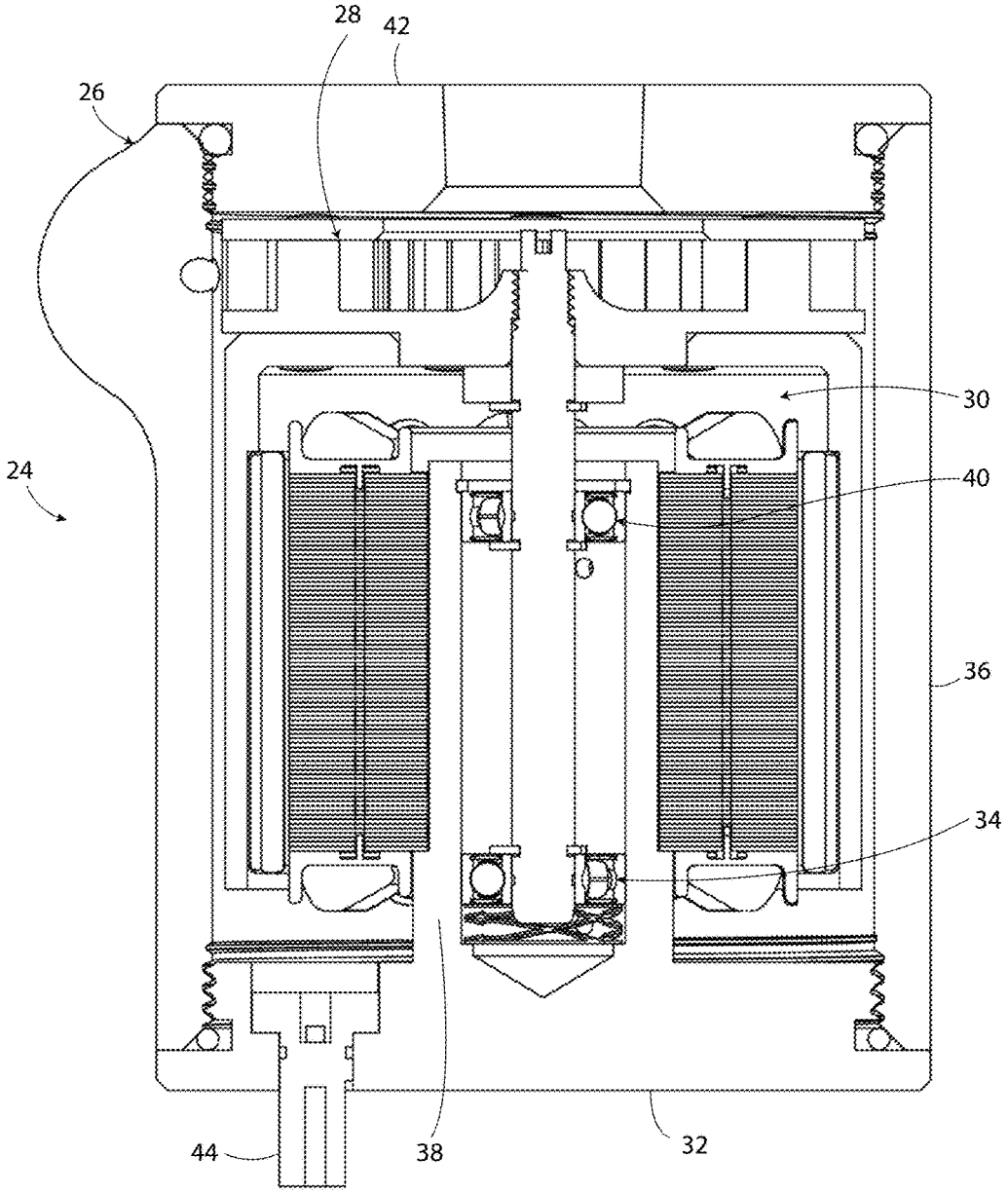
FIG. 4 is a cross-sectional view taken along the plane of line 4-4 of FIG. 3.
Figure 5:
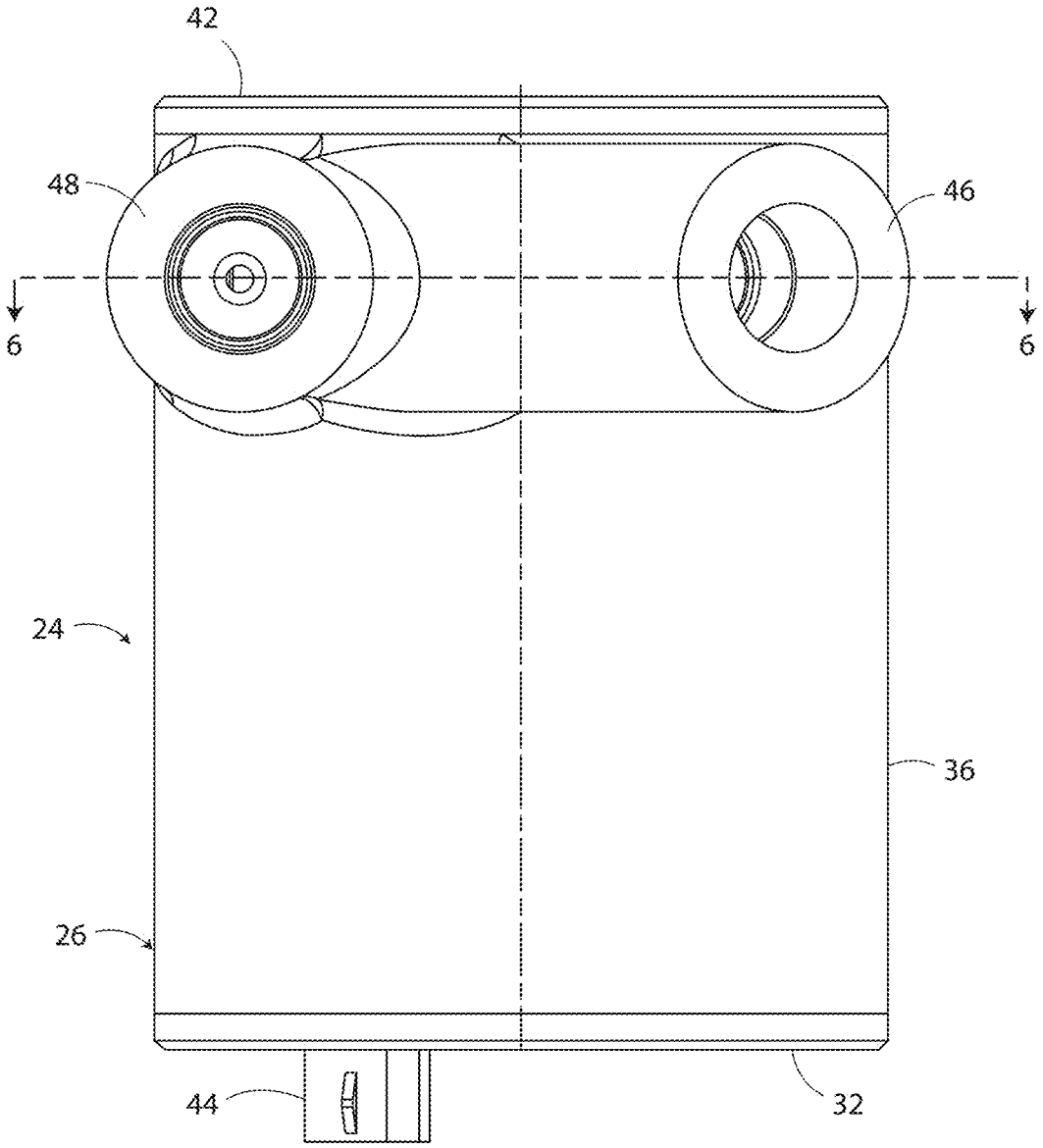
FIG. 5 is a side-elevational view of the energy recovery apparatus of FIGS. 1-4.

Reference numerals in the written specification and in the drawing figures indicate corresponding items.

DETAILED DESCRIPTION

An embodiment of a refrigeration system of the present invention is indicated generally by reference numeral 16 in FIG. 1. One aspect of the present invention is an energy recovery apparatus for use in a refrigeration system. The refrigeration system 16 comprises an evaporator 18, a compressor 20, a condenser 22, and an energy recovery apparatus 24. The refrigeration system 16 is configured to circulate refrigerant along a flow path such that the refrigerant flows from the evaporator 18 to the compressor 20, and from the compressor to the condenser 22, and from the condenser to the energy recovery apparatus 24, and from the energy recovery apparatus to the evaporator.

Referring to FIGS. 2-6, the energy recovery apparatus 24 is basically comprised of a housing 26, a turbine 28 and a generator 30. The turbine 28 and generator 30 are preferably contained in the housing. The housing 26 preferably comprises three parts. A first, center housing part 32 has an interior that supports a bearing assembly 34. The center part 32 is attached to a second, side wall part 36 of the housing. The side wall 36 is preferably generally cylindrical in shape and extends around an interior volume of the housing 26. The center housing part 32 also includes a hollow center column 38. The interior of the center column 38 supports a second bearing assembly 40. A third, cover part of the housing 42 is attached to the top of the side wall 36. The cover part 42 encloses the hollow interior of the housing 26. The center housing part 32 preferably has an outlet opening (or discharge port) 44 that is the outlet for the refrigerant passing through the expansion energy recovery apparatus 24. The discharge port 44 of the energy recovery apparatus 24 is downstream of the turbine 28.

Figure 6:
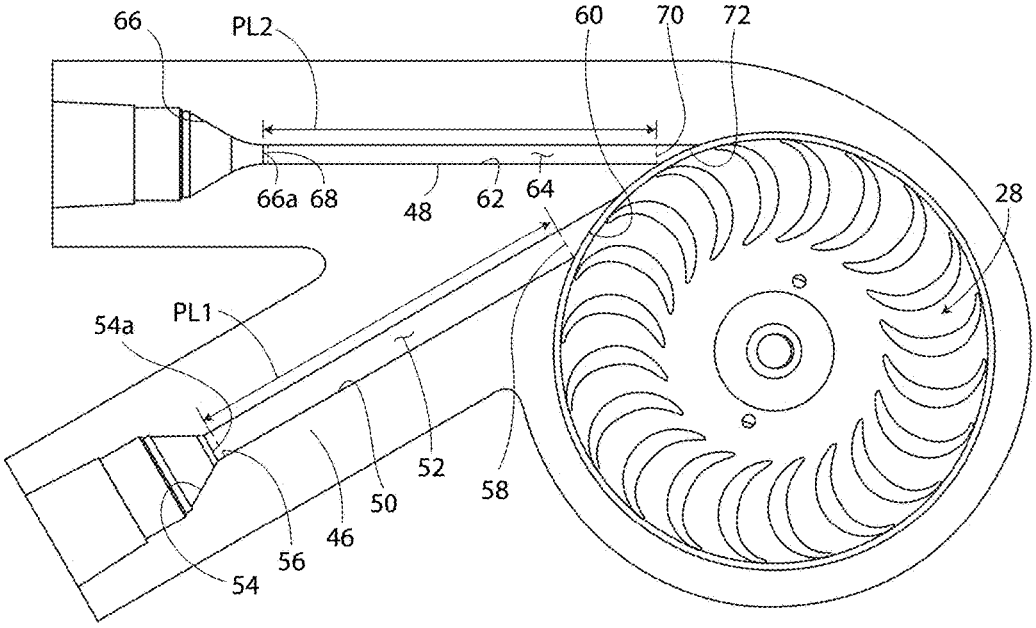
FIG. 6 is a cross-sectional view taken along the plane of line 6-6 of FIG. 5.

The energy recovery apparatus 24 is similar to the energy recovery apparatus described in co-pending U.S. patent application Ser. No. 13/948,942 filed Jul. 23, 2013 (incorporated herein by reference) except the energy recovery apparatus 24 of the present invention includes two nozzles. In particular, the energy recovery apparatus 24 further includes a first nozzle 46 and a second nozzle 48. The first and second nozzles 46, 48 may be integrally formed with the side wall 36 as a single, unitary, monolithic piece as shown in FIG. 6, or they may be components extending through the housing 26 (not shown). Refrigerant entering the expansion energy recovery apparatus 24 passes through the first nozzle 46, or through the second nozzle 48, or simultaneously through both nozzles.

The first nozzle 46 comprises a first conduit region 50 defining a first passageway 52. The first nozzle further comprises a first necked-down region 54. The first passageway 52 is downstream of the first necked-down region 54. The first necked down region 54 and the first passageway 52 are adapted to constitute portions of the flow path when the refrigeration system is operated in a first mode. The first passageway 52 has an upstream cross-section, indicated by the dash line 56, a downstream cross-section, indicated by the dash line 58, a first passageway length PL1 extending from the upstream cross-section 56 of the first passageway to the downstream cross-section 58 of the first passageway, and a discharge end 60. The downstream cross-section 58 of the first passageway 52 is closer to the discharge end 60 of the first passageway 52 than to the upstream cross section 56 of the first passageway. The first nozzle 46 is adapted and configured such that refrigerant is expanded as it passes through the first nozzle and is discharged from the discharge end 60 of the first passageway 52 in a liquid-vapor state with a liquid component and a vapor component. The second nozzle 48 comprises a second conduit region defining a second passageway.

The second nozzle 48 comprises a second conduit region 62 defining a second passageway 64. The second nozzle 48 further comprises a second necked-down region 66. The second passageway 64 is downstream of the second necked-down region 66. The second necked-down region 66 and the second passageway 64 are adapted to constitute portions of the flow path when the refrigeration system is operated in a second mode. The second passageway 64 has an upstream cross-section, indicated by the dash line 68, a downstream cross-section, indicated by the dash line 70, a second passageway length PL2 extending from the upstream cross-section 68 of the second passageway 64 to the downstream cross-section 70 of the second passageway, and a discharge end 72. The downstream cross-section 70 of the second passageway 64 is closer to the discharge end 72 of the second passageway than to the upstream cross section 68 of the second passageway. The second nozzle 48 is adapted and configured such that refrigerant is expanded as it passes through the second nozzle and is discharged from the discharge end 72 of the second passageway in a liquid-vapor state with a liquid component and a vapor component. The turbine 28 is positioned and configured to be driven by refrigerant discharged from the discharge end 60 of the first passageway 52 and by refrigerant discharged from the discharge end 72 of the second passageway 64. The discharge port 44 is adapted to permit refrigerant to flow out of the energy recovery apparatus 24. The discharge port 44 of the energy recovery apparatus 24 is downstream of the turbine 28.

The first necked-down region 54 has a downstream end 54*a* and the second necked-down region 66 has a downstream end 66*a*. The downstream end 54*a* of the first necked-down region 54 has a cross-sectional area less than a cross-sectional area of the intake opening of the first nozzle 46. The downstream end 66*a* of the second necked-down region 66 has a cross-sectional area less than a cross-sectional area of the intake opening of the second nozzle 48. Preferably, each necked-down region 54, 66 gradually decreases in cross-sectional area toward its downstream end 54*a*, 66*a*, respectively. Alternatively, each necked-down region may abruptly decrease in cross-sectional area without departing from the scope of the present invention.

Preferably, the first and second passageways 52, 64 are each in the form of a cylindrical bore, but can be of other shapes without departing from the scope of this invention. In the present embodiment, the downstream cross-section 58 of the first passageway 52 is adjacent the discharge (downstream) end 60 of the first passageway 52, and the downstream cross-section 70 of the second passageway 64 is adjacent the discharge (downstream) end 72 of the second passageway 64.

The downstream cross-section 58 of the first passageway 52 has a first effective diameter defined as $(4A1/\pi)^{1/2}$, where A1 is the cross-sectional area of the first passageway 52 at the downstream cross-section 58 of the first passageway. The downstream cross-section 70 of the second passageway 64 has a second effective diameter defined as $(4A2/\pi)^{1/2}$, where A2 is the cross-sectional area of the second passageway 64 at the downstream cross-section 70 of the second passageway 64. As used herein, the cross-sectional area is the planar area generally perpendicular to the intended direction of flow at the given point in the first or second passageway, e.g., at the downstream cross-section 58 or 70 of the first or second passageway. The cross section of each of the first and second passageways 52, 64 at any point along the passageway length PL1, PL2 is preferably circular, but it is to be understood that other cross-sectional shapes may be employed without departing from this invention. Preferably, the cross-sectional area of the first passageway 52 at the downstream cross-section 58 of the first passageway is not greater than the cross-sectional area of the first passageway at any point along the first passageway length PL1, and the cross-sectional area of the second passageway 64 at the downstream cross-section 70 of the second passageway is not greater than the cross-sectional area of the second passageway at any point along the second passageway length PL2. In the present embodiment, the first passageway 52 has a generally constant cross-sectional area along the first passageway length PL1, and the second passageway 64 has a generally constant cross-sectional area along the second passageway length PL2. The cross-sectional area of the first passageway 52 may be different from the cross-sectional area of the second passageway 64 or may be the same as the cross-sectional area of the second passageway. If the cross-sectional area of the first passageway 52 is the same as the cross-sectional area of the second passageway 64, it is contemplated that the refrigerant will flow through only one of the first and second passageways when the refrigeration system is operated in the first mode, and will simultaneously flow through both the first and second passageways when the refrigeration system is operated in the second mode. Even if the cross-sectional areas of the first and second passageways 52, 64 are the same and the discharge cross-sectional areas are the same, the effective discharge cross-sectional areas will be different for the two modes of operation because in one mode of operation refrigerant will be discharged from only one passageway and in the other mode of operation refrigerant will simultaneously be discharged from both passageways.

Preferably, the passageway length PL1 of the first passageway 52 is at least five times the first effective diameter, and more preferably at least seven and one-half times the first effective diameter, and more preferably at least ten times the first effective diameter, and even more preferably at least twelve and one-half times the first effective diameter. The passageway length PL2 of the second passageway 64 is preferably at least five times the second effective diameter, and more preferably at least seven and one-half times the second effective diameter, and more preferably at least ten times the second effective diameter, and even more preferably at least twelve and one-half times the second effective diameter.

The first nozzle 46 is preferably adapted and configured such that the liquid component of the refrigerant discharged from the discharge end 60 of the first passageway 52 has a velocity that is at least 60% that of the velocity of the vapor component of the refrigerant discharged from the discharge end 60 of the first passageway and more preferably has a velocity that is at least 70% of the velocity of the vapor component of the refrigerant discharged from the discharge end of the first passageway. Likewise, the second nozzle 48 is preferably adapted and configured such that the liquid component of the refrigerant discharged from the discharge end 72 of the second passageway 64 has a velocity that is at least 60% that of the velocity of the vapor component of the refrigerant discharged from the discharge end 72 of the second passageway and more preferably has a velocity that is at least 70% of the velocity of the vapor component of the refrigerant discharged from the discharge end 72 of the second passageway. If the refrigerant is expanded too rapidly in the nozzle (e.g., if the passageway is insufficiently long), then the velocity of the liquid component will be insufficient to impart the desired force on the turbine blades 50.

Preferably, the first nozzle 46 is adapted and configured to discharge the liquid component of the refrigerant from the discharge end 60 of the first passageway 52 at a velocity of at least about 190 feet per second (58 m/s) and more preferably at a velocity of at least about 220 feet/second (67 m/s). Preferably the second nozzle 48 is adapted and configured to discharge the liquid component of the refrigerant from the discharge end 72 of the second passageway 64 at a velocity of at least about 190 feet per second (58 m/s) and more preferably at a velocity of at least about 220 feet/second (67 m/s). Also, the passageways should not be made excessively long such that the pressure of the refrigerant is too low to match the pressure requirements of the evaporator.

Preferably, each of the nozzles 46, 48 is shaped and configured such that refrigerant entering the nozzle at X % liquid and (100−X) % vapor, by mass, is expanded as it passes through the nozzle and is discharged from the discharge end of the corresponding passageway in a liquid-vapor state with a liquid component that is at most at (X−5) % and a vapor component that is at least (105−X) %, by mass. One of ordinary skill in the art will appreciate that "X", as used herein, is typically the number 100, but could be a number somewhat less than 100.

Referring again to the embodiment of FIG. 1, the compressor 20 of the refrigeration system 16 is preferably a multi-speed compressor, such as a two-speed compressor, operable in at least a first speed and a second speed different from the first speed. The refrigeration system 16 is configured and adapted such that the first passageway 52 is in the flow path when the compressor 20 is operated at the first speed, and is configured and adapted such that the second passageway 64 is in the flow path when the compressor 20 is operated at the second speed but not when the compressor is operated at the first speed. The refrigeration system 16 further includes an electrically-actuated valve 80 (e.g., a solenoid valve), or other suitable valve. In the embodiment of FIG. 1, the first nozzle 46 is in the flow path regardless of whether the compressor is operated at the first or second speed, and the electrically-actuated valve 80 is adapted and configured to cause the second passageway to be in the flow path only when the compressor is operated at the second speed. In the present embodiment, operating the compressor 20 at the first speed and placing the first necked-down region 54 and the first passageway 52 of the first nozzle 46 in the refrigerant flow path corresponds to the first mode of operation of the refrigeration system 16. Likewise, operating the compressor 20 at the second speed and placing the second necked-down region 66 and the second passageway 64 of the second nozzle 48 in the refrigerant flow path corresponds to the first mode of operation of the refrigeration system 16.

The energy recovery apparatus of the present invention may be sold or distributed as part of a complete refrigerant system or as a separate unit to be added to a refrigerant system (e.g., to replace an expansion valve of an existing refrigeration system). In connection with the sale or distribution of the energy recovery apparatus, a user (e.g., a purchaser of the energy recovery apparatus) is instructed that the purpose of the energy recovery apparatus is to expand refrigerant in a refrigerant system. The user is induced to have the energy recovery apparatus placed in fluid communication with a fluid line of a refrigeration system, and to have the energy recovery apparatus placed in fluid communication with a condenser and evaporator of a refrigeration system.

Figure 7:
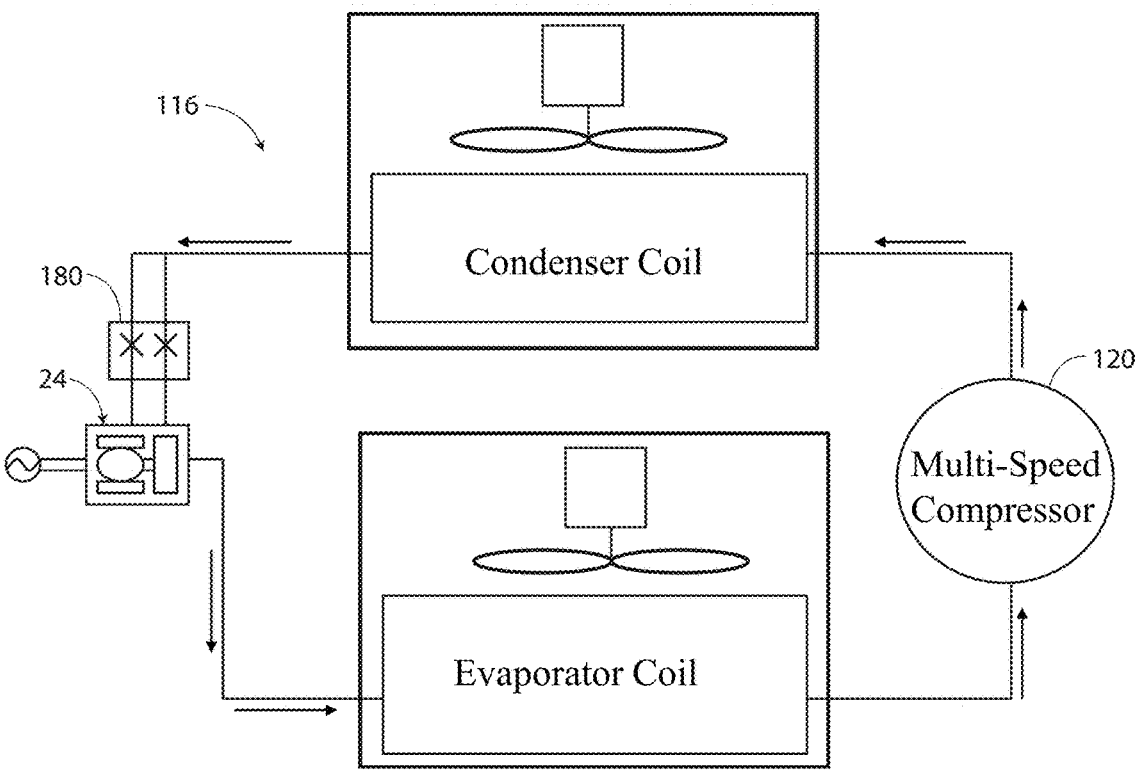
FIG. 7 is a schematic view of another embodiment of a refrigeration system of the present invention, the refrigeration system including a multi-speed compressor and the energy recovery apparatus of FIGS. 1-6.

Referring to FIG. 7, another embodiment of a refrigeration system of the present invention is generally indicated at reference numeral 116. The refrigeration system 116 is similar to the refrigeration system 16 of FIGS. 1-6, and the description above with respect to the refrigeration system 16 is equally applicable to the refrigeration system of FIG. 7, except for the electrically-actuated valve, and perhaps the compressor. In the embodiment of FIG. 7, the electrically-actuated valve 180 comprises a twin-solenoid valve or other suitable valve opens the first nozzle 46, or the second nozzle 48, or both nozzles, depending on the system requirements of the multi-speed compressor 120 of the refrigeration system 116.

Figure 8:
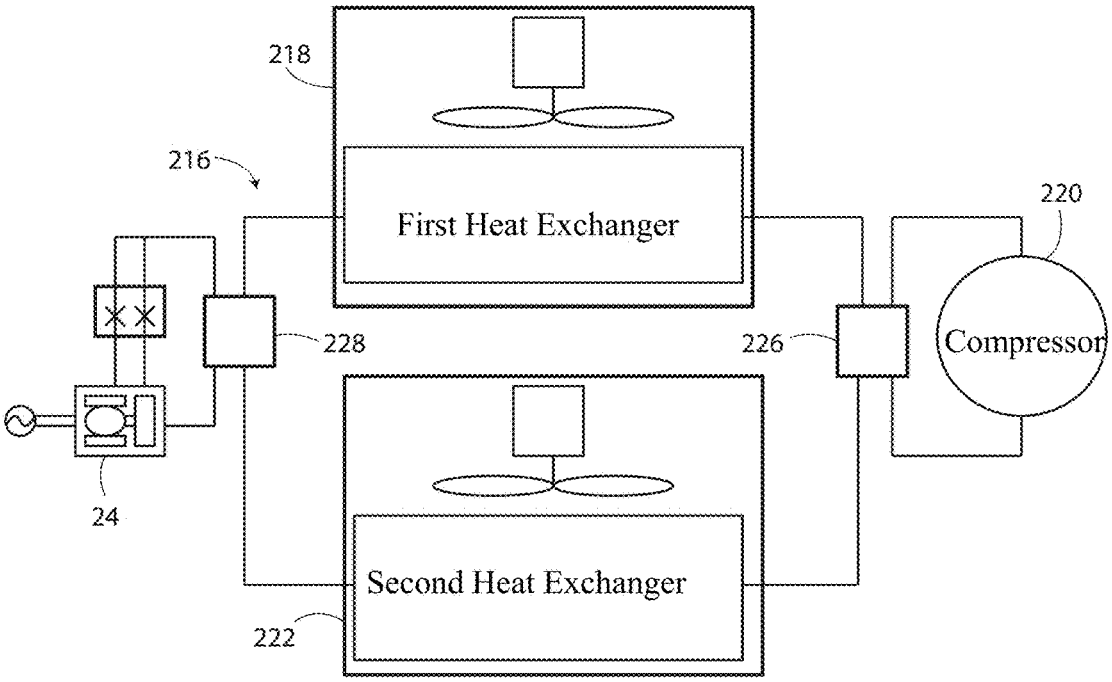
FIG. 8 is a schematic view of an embodiment of another refrigeration system of the present invention, the refrigeration system comprising a heat pump system incorporating the energy recovery apparatus of FIGS. 1-6.

Another embodiment of a refrigeration system of the present invention is shown schematically in FIG. 8. The refrigeration system of FIG. 8 is a heat pump system 216 adapted to be operated in a heating mode and in a cooling mode. The heat pump system 216 comprises a first heat exchanger 218, a compressor 220, a second heat exchanger 222, and an energy recovery apparatus 24. When used to heat a cool a residence, for example, the first heat exchanger could be an inside heat exchanger within the residence and the second heat exchanger could be an outside heat exchanger outside the residence. The above description of the energy recovery apparatus 24 of FIGS. 1-6 applies equally to the energy recovery apparatus 24 of FIG. 8. The heat pump system 216 is configured to circulate refrigerant along a first flow path (e.g., a generally clock-wise direction with respect to the schematic of FIG. 8) when the heat pump system is operated in one of the heating or cooling modes and configured to circulate refrigerant along a second flow path (e.g., a generally counter-clock-wise direction with respect to the schematic of FIG. 8) when the heat pump system is operated in the other of the heating or cooling modes. The heat pump system 216 is configured such that refrigerant flowing along the first flow path flows from the first heat exchanger 218 to the compressor 220, and from the compressor to the second heat exchanger 222, and from the second heat exchanger to the energy recovery apparatus 24, and from the energy recovery apparatus to the first heat exchanger 218. The heat pump system 216 is configured such that refrigerant flowing along the second flow path flows from the second heat exchanger 222 to the compressor 220, and from the compressor to the first heat exchanger 218, and from the first heat exchanger to the energy recovery apparatus 24, and from the energy recovery apparatus to the second heat exchanger 222. In one mode of operation the first heat exchanger 218 functions as an evaporation and the second heat exchanger 222 functions as a condenser, and in the other mode of operation the first heat exchanger functions as a condenser and the second heat exchanger functions as an evaporator. Refrigerant flows through the first passageway 52 of the energy recovery apparatus 24 when the heat pump system 216 is operated in the mode which causes refrigerant to flow along the first flow path. Refrigerant flows through the second passageway 64 of the energy recovery apparatus 24 when the heat pump system 216 is operated in the mode which causes refrigerant to flow along the second flow path but not when the heat pump system is operated in the mode which causes refrigerant to flow along the first flow path. The heat pump system 216 may be configured such that refrigerant flows through both the first and second passageways 52, 64 of the energy recovery apparatus 24 when the heat pump system is operated in the mode which causes refrigerant to flow along the second flow path, or only through the second passageway 64 depending on system requirements.

The heat pump system 216 preferably also includes first and second reversing valves 226, 228 each being movable between a first configuration and a second configuration. The first and second reversing valves 226, 228 are in the first configurations when the heat pump system 216 is operated in the mode which causes refrigerant to flow along the first flow path and are in the second configurations when the heat pump system is operated in the mode which causes refrigerant to flow along the second flow path. The heat pump system is adapted and configured such that refrigerant flows from the compressor 220 to the second heat exchanger 222 via the first reversing valve 226 and from second heat exchanger 222 to the energy recovery apparatus 24 via the second reversing valve 228 when the heat pump system is operated in the mode which causes refrigerant to flow along the first flow path. Refrigerant flows from the compressor 220 to the first heat exchanger 218 via the first reversing valve 226 and from the first heat exchanger 218 to the energy recovery apparatus 24 via the second reversing valve 228 when the heat pump system is operated in the mode which causes refrigerant to flow along the second flow path.

Figure 9:
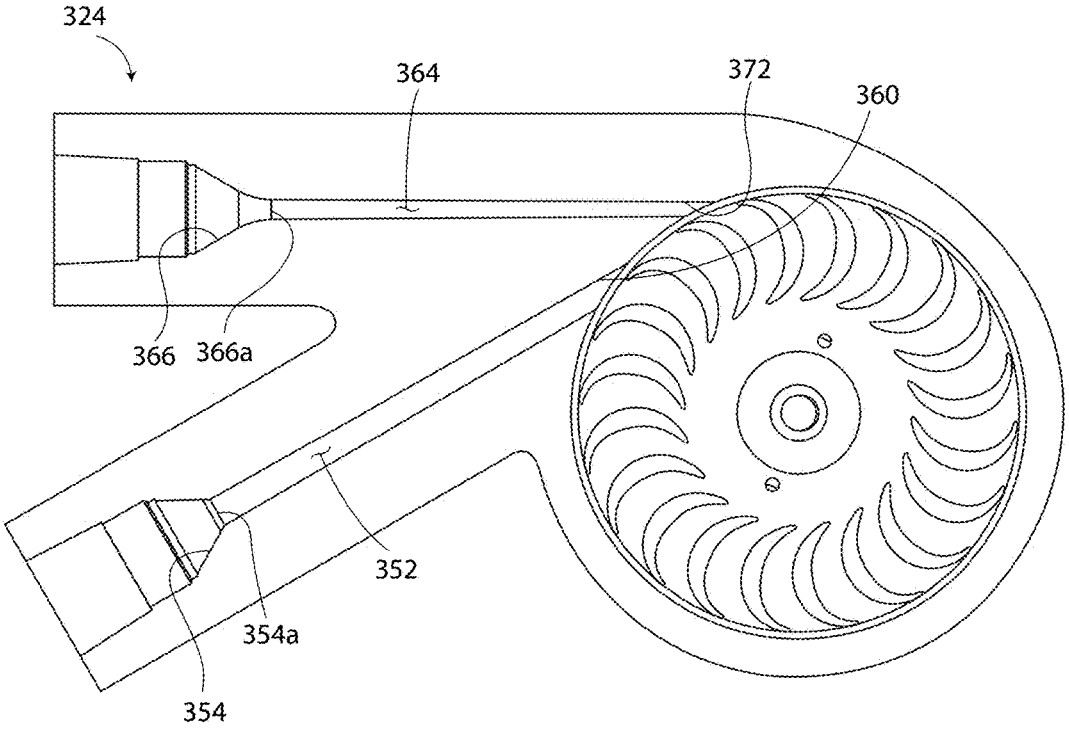
FIG. 9 is a cross-section view of another embodiment of an energy recovery apparatus of the present invention, similar to FIG. 6, but having converging passageways.

Another embodiment of an energy recovery apparatus of the present invention is indicated generally by reference number 324 in FIG. 9. The energy recovery apparatus 324 is the same as the energy recovery apparatus 24 of FIGS. 1-6 except for the differences noted herein. In particular, the first passageway 352 converges as it extends toward the discharge end 360 of the first passageway, and the second passageway 364 converges as it extends toward the discharge end 372 of the second passageway. In this embodiment, at least a portion of each passageway converges as it extends toward the discharge end of such passageway. Preferably, the first passageway 352 converges from the downstream end 354*a* of the first necked-down region 354 to the discharge end 360, and the second passageway 364 converges from the downstream end 366*a* of the second necked-down region 366 to the discharge end 372.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed.

What is claimed is:

1. A refrigeration system comprising an evaporator, a multi-speed compressor operable in at least a first speed and a second speed different from the first speed, a condenser, and an energy recovery apparatus, the refrigeration system being configured to circulate refrigerant along a flow path such that the refrigerant flows from the evaporator to the compressor, and from the compressor to the condenser, and from the condenser to the energy recovery apparatus, and from the energy recovery apparatus to the evaporator, the energy recovery apparatus comprising:

a first nozzle comprising a first conduit region defining a first passageway, the first passageway having a discharge end, the first passageway being adapted to constitute a portion of the flow path when the refrigeration system is operated in a first mode, the first nozzle being adapted and configured such that refrigerant is expanded as it passes through the first nozzle and is discharged from the discharge end of the first passageway in a liquid-vapor state with a liquid component and a vapor component;

a second nozzle comprising a second conduit region defining a second passageway, the second passageway having a discharge end, the second passageway being adapted to constitute a portion of the flow path when the refrigeration system is operated in a second mode, the second nozzle being adapted and configured such that refrigerant is expanded as it passes through the second nozzle and is discharged from the discharge end of the second passageway in a liquid-vapor state with a liquid component and a vapor component;

a turbine positioned and configured to be driven by refrigerant discharged from the discharge end of the first passageway and by refrigerant discharged from the discharge end of the second passageway;

a generator coupled to the turbine and adapted to be driven by the turbine;

a discharge port adapted to permit refrigerant to flow out of the energy recovery apparatus, the discharge port of the energy recovery apparatus being downstream of the turbine; and a housing, the turbine being within the housing;

the refrigeration system being configured and adapted such that the first passageway is in the flow path when the compressor is operated at the first speed but not when the compressor is operated at the second speed, and the refrigeration system being configured and adapted such that the second passageway is in the flow path when the compressor is operated at the second speed but not when the compressor is operated at the first speed.

2. A refrigeration system as set forth in claim 1 wherein the first conduit region of the first nozzle is integrally formed as a portion of the housing, and wherein the second conduit region of the second nozzle is integrally formed as a portion of the housing.

3. A refrigeration system as set forth in claim 1 wherein the generator is within the housing.

4. A refrigeration system as set forth in claim 1 wherein each of the first and second passageways has an upstream cross-section, a downstream cross-section, and a passageway length extending from the upstream cross-section to the downstream cross-section, the downstream cross-section of the first passageway being closer to the discharge end of the first passageway than to the upstream cross-section of the first passageway, the downstream cross-section of the second passageway being closer to the discharge end of the second passageway than to the upstream cross-section of the second passageway, the cross-sectional area of the first passageway at the downstream cross-section of the first passageway being not greater than the cross-sectional area of the first passageway at any point along the passageway length of the first passageway, the cross-sectional area of the second passageway at the downstream cross-section of the second passageway being not greater than the cross-sectional area of the second passageway at any point along the passageway length of the second passageway.

5. A refrigeration system as set forth in claim 4 wherein the downstream cross-section of the first passageway has a first effective diameter, and wherein the downstream cross-section of the second passageway has a second effective diameter, the first effective diameter being defined as $(4A_1/\pi)^{1/2}$, where $A_1$ is the cross-sectional area of the first passageway at the downstream cross-section of the first passageway, the second effective diameter being defined as $(4A_2/\pi)^{1/2}$, where $A_2$ is the cross-sectional area of the second passageway at the downstream cross-section of the second passageway, the passageway length of the first passageway being at least five times the first effective diameter, the passageway length of the second passageway being at least five times the second effective diameter.

6. A refrigeration system as set forth in claim 5 wherein the passageway length of the first passageway is at least seven and one-half times the first effective diameter, and the passageway length of the second passageway is at least seven and one-half times the second effective diameter.

7. A refrigeration system as set forth in claim 5 wherein the passageway length of the first passageway is at least ten times the first effective diameter, and the passageway length of the second passageway is at least ten times the second effective diameter.

8. A refrigeration system as set forth in claim 5 wherein the passageway length of the first passageway is at least twelve and one-half times the first effective diameter, and the passageway length of the second passageway is at least twelve and one-half the second effective diameter.

9. A refrigeration system as set forth in claim 1 wherein the first nozzle is adapted and configured such that the liquid component of the refrigerant discharged from the discharge end of the first passageway has a velocity that is at least 60% that of the vapor component of the refrigerant discharged from the discharge end of the first passageway, and wherein the second nozzle is adapted and configured such that the liquid component of the refrigerant discharged from the discharge end of the second passageway has a velocity that is at least 60% that of the vapor component of the refrigerant discharged from the discharge end of the second passageway.

10. A refrigeration system as set forth in claim 1 wherein the first nozzle is adapted and configured to discharge the liquid component of the refrigerant from the discharge end of the first passageway at a velocity of at least about 190 feet per second, and wherein the second nozzle is adapted and configured to discharge the liquid component of the refrigerant from the discharge end of the second passageway at a velocity of at least about 190 feet per second.

11. A refrigeration system as set forth in claim 1 wherein the first passageway has a generally constant cross-sectional area along the passageway length of the first passageway, and wherein the second passageway has a generally constant cross-sectional area along the passageway length of the second passageway.

12. A refrigeration system as set forth in claim 11 wherein the cross-sectional area of the first passageway is different from the cross-sectional area of the second passageway.

13. A refrigeration system as set forth in claim 1 wherein the first nozzle further comprises a first necked down-region, the first passageway being downstream of the first necked-down region, the first necked-down region being adapted to constitute a portion of the flow path when the refrigeration system is operated in the first mode, and wherein the second nozzle further comprises a second necked down-region, the second passageway being downstream of the second necked-down region, the second necked-down region being adapted to constitute a portion of the flow path when the refrigeration system is operated in the second mode.

14. A refrigeration system as set forth in claim 13 wherein at least a portion of the first passageway converges as it extends toward the discharge end of the first passageway, and wherein at least a portion of the second passageway converges as it extends toward the discharge end of the second passageway.

15. A refrigeration system as set forth in claim 1 further comprising an electrically actuated valve adapted and configured to cause the second passageway to be in the flow path only when the compressor is operated at the second speed.

16. A heat pump system adapted to be operated in a heating mode and in a cooling mode, the heat pump system comprising a first heat exchanger, a second heat exchanger, a compressor, and an energy recovery apparatus, the heat pump system being configured to circulate refrigerant along a first flow path when the heat pump system is operated in one of the heating or cooling modes and configured to circulate refrigerant along a second flow path when the heat pump system is operated in the other of the heating or cooling modes, the heat pump system being configured such that refrigerant flowing along the first flow path flows from the first heat exchanger to the compressor, and from the compressor to the second heat exchanger, and from the second heat exchanger to the energy recovery apparatus, and from the energy recovery apparatus to the first heat exchanger, the heat pump system being configured such that refrigerant flowing along the second flow path flows from the second heat exchanger to the compressor, and from the compressor to the first heat exchanger, and from the first heat exchanger to the energy recovery apparatus, and from the energy recovery apparatus to the second heat exchanger, the energy recovery apparatus comprising:

a first nozzle comprising a first conduit region defining a first passageway, the first passageway having a discharge end, the first passageway being adapted to constitute a portion of the flow path when the refrigeration system is operated in a first mode, the first nozzle being adapted and configured such that refrigerant is expanded as it passes through the first nozzle and is discharged from the discharge end of the first passageway in a liquid-vapor state with a liquid component and a vapor component;

a second nozzle comprising a second conduit region defining a second passageway, the second passageway having a discharge end, the second passageway being adapted to constitute a portion of the flow path when the refrigeration system is operated in a second mode, the second nozzle being adapted and configured such that refrigerant is expanded as it passes through the second nozzle and is discharged from the discharge end of the second passageway in a liquid-vapor state with a liquid component and a vapor component;

a turbine positioned and configured to be driven by refrigerant discharged from the discharge end of the first passageway and by refrigerant discharged from the discharge end of the second passageway:

a generator coupled to the turbine and adapted to be driven by the turbine;

a discharge port adapted to permit refrigerant to flow out of the energy recovery apparatus, the discharge port of the energy recovery apparatus being downstream of the turbine; and a housing, the turbine being within the housing:

the heat pump system being configured and adapted such that refrigerant flows through the first passageway of the energy recovery apparatus when the heat pump system is operated in the mode which causes refrigerant to flow along the first flow path but not when the heat pump system is operated in the mode which causes refrigerant to flow along the second flow path, and the heat pump system being configured and adapted such that refrigerant flows through the second passageway of the energy recovery apparatus when the heat pump system is operated in the mode which causes refrigerant to flow along the second flow path but not when the heat pump system is operated in the mode which causes refrigerant to flow along the first flow path.

17. A heat pump system as set forth in claim 16 further comprising first and second reversing valves each being movable between a first configuration and a second configuration, the heat pump system being configured and adapted such that the first and second reversing valves are in the first configuration when the heat pump system is operated in the mode which causes refrigerant to flow along the first flow path and are in the second configuration when the heat pump system is operated in the mode which causes refrigerant to flow along the second flow path, the heat pump system being adapted and configured such that refrigerant flows from the compressor to the second heat exchanger via the first reversing valve and from second heat exchanger to the energy recovery apparatus via the second reversing valve when the heat pump system is operated in the mode which causes refrigerant to flow along the first flow path, the heat pump system being adapted and configured such that refrigerant flows from the compressor to the first heat exchanger via the first reversing valve and from the first heat exchanger to the energy recovery apparatus via the second reversing valve when the heat pump system is operated in the mode which causes refrigerant to flow along the second flow path.

18. An energy recovery apparatus for use in a refrigeration system, the refrigeration system comprising an evaporator, a compressor and a condenser, the refrigeration system being configured to circulate refrigerant along a flow path such that the refrigerant flows from the evaporator to the compressor, and from the compressor to the condenser, and from the condenser to the evaporator, the energy recovery apparatus being adapted and configured to be in the flow path operatively between the condenser and the evaporator, the energy recovery apparatus comprising:

a nozzle apparatus adapted to be in the flow path and configured to expand refrigerant passing through the nozzle apparatus, the nozzle apparatus being adapted to be operable in first and second modes, the nozzle apparatus having a first discharge cross-sectional area through which refrigerant is discharged in a liquid-vapor state with a liquid component and a vapor component when the nozzle apparatus is operated in the first mode, the nozzle apparatus having a second discharge cross-sectional area through which refrigerant is discharged in a liquid-vapor state with a liquid component and a vapor component when the nozzle apparatus is operated in the second mode, the second discharge cross-sectional area being different from the first discharge cross-sectional area;

a turbine positioned and configured to be driven by refrigerant discharged from the first discharge cross-sectional area only when the nozzle apparatus is operated in the first mode, the turbine being positioned and configured to be driven by refrigerant discharged from the second discharge cross-sectional area only when the nozzle apparatus is operated in the second mode;

a discharge port adapted to permit refrigerant to flow out of the energy recovery apparatus, the discharge port of the energy recovery apparatus being downstream of the turbine; and a housing, the turbine being within the housing.

19. An energy recovery apparatus as set forth in claim 18 further comprising a generator coupled to the turbine and adapted to be driven by the turbine.

20. An energy recovery apparatus as set forth in claim 19 wherein the generator is within the housing.

* * * * *